United States Patent [19]

Harvey et al.

[11] Patent Number: 4,799,964

[45] Date of Patent: Jan. 24, 1989

[54] PREPARATION OF FILLER COMPOSITIONS FOR PAPER

[75] Inventors: Richard D. Harvey; Robert E. Klem, both of Muscatine, Iowa

[73] Assignee: Grain Processing Corporation, Muscatine, Iowa

[21] Appl. No.: 45,221

[22] Filed: Apr. 29, 1987

Related U.S. Application Data

[63] Continuation of Ser. No. 760,277, Jul. 29, 1985, abandoned.

[51] Int. Cl.[4] ..... C04B 14/00

[52] U.S. Cl. ..... 106/436; 106/464; 106/468; 106/486; 106/487; 106/501

[58] Field of Search ..... 106/288 B, 308 C, 309

[56] References Cited

U.S. PATENT DOCUMENTS

| | | | |
|---|---|---|---|
| 3,873,336 | 3/1975 | Lambert et al. | 106/308 C |
| 4,174,998 | 11/1979 | Shiel | 106/308 C |
| 4,210,490 | 7/1980 | Taylor | 106/288 B |
| 4,272,297 | 6/1981 | Brooks et al. | 106/308 C |
| 4,282,059 | 8/1981 | Davidson | 162/168 |
| 4,295,933 | 10/1981 | Smith | 162/168 |
| 4,372,814 | 2/1983 | Johnstone et al. | 162/124 |

*Primary Examiner*—Paul Lieberman
*Assistant Examiner*—Willie J. Thompson
*Attorney, Agent, or Firm*—Neuman, Williams, Anderson & Olson

[57] ABSTRACT

A process for forming a preflocculated filler for use in making paper, which process comprises continuously bringing together an aqueous slurry of a paper filler material and a flocculating agent and imparting to the mixture for a period of not more than about 2 minutes and preferably for less than about 30 seconds, a shearing force sufficient to provide a flocculated filler of controlled particle size and most suitable for papermaking.

7 Claims, 4 Drawing Sheets

FIG. 1
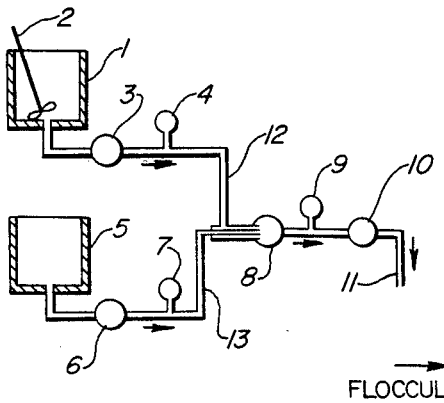
FIG. 2
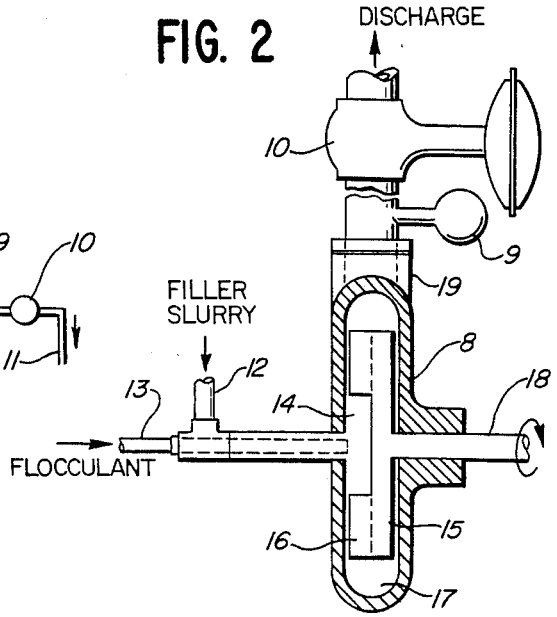
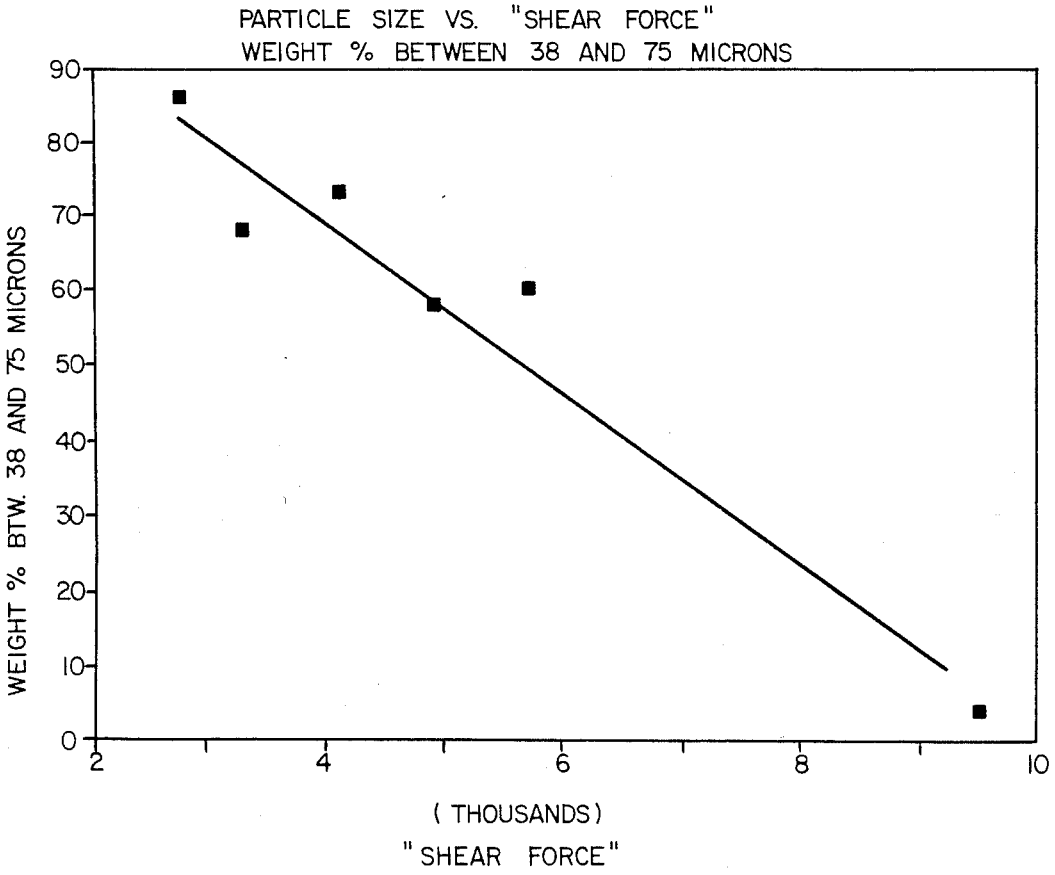
FIG. 3

PREPARATION OF FILLER COMPOSITIONS FOR PAPER

This application is a continuation, of application Ser. No. 760,277, filed July 29, 1985 abandoned.

This invention relates to the paper and paperboard art. In a more particular aspect, the invention relates to the preparation of flocculated filler compositions for use in the manufacture of paper and paperboard.

As is well known, paper and paperboard are manufactured from fibers. Very typically, paper is manufactured from cellulosic fibers by depositing an aqueous stock or furnish of such fibers onto a mesh screen and removing the water therefrom to form a paper or paperboard web consisting of interlocked fibers. It is customary in the paper art to incorporate in the paper furnish a mineral filler to improve the surface of the paper for printing purposes and to reduce production costs. Since cellulosic fibers are relatively expensive, production costs can be significantly reduced by replacing a portion of cellulosic fibers with a less costly mineral filler, such as a clay or calcium carbonate. The efficient retention of filler particles in the paper sheet during its formation is troublesome since the fillers tend to be lost into the water drained from the wet-formed paper web. Non-retained filler increases the waste load and requires an excessive filler loading in the furnish for the papermaking process. To alleviate these problems, flocculating agents are used with the filler to increase the effective particle size of the filler thus improving its retention in the paper web. Such flocculated filler compositions exhibit enhanced retention with the cellulosic fibers and enable higher filler concentrations to be utilized in the paper.

Flocculated filler compositions which are formed prior to incorporation into the cellulosic fiber furnish are known as preflocculated fillers. Flocculated fillers of controlled particle size are very much desired in the papermaking industry for a number of reasons, e.g., to improve filler retention thus reducing materials cost and minimizing save-all loads; to enable high filler retention to be achieved while maintaining good sheet formation and to reduce the cost of papermaking by replacing more expensive fibers with the less costly filler materials.

Heretofore, batch operations have frequently been employed to produce a "macrofloc" filler composition which is then sheared to a "microfloc" of a desired smaller particle size. These batch operations are generally conducted using low concentrations of flocculating agents, particularly when flocculation of the filler takes place in the presence of the paper pulp furnish. Batch processes for preparing flocculated filler compositions are slow, energy intensive, difficult to scale-up and the product is inconsistent from batch-to-batch.

It is therefore a principal object of the present invention to provide an improved and advantageous method for producing a preflocculated filler composition for use in paper and paperboard.

It is a further object of the invention to provide an improved, energy-efficient process for producing on a continuous basis a preflocculated filler composition for use in paper and paperboard.

It is a further object of the invention to provide a process for preparing a preflocculated filler composition using readily available equipment which is relatively simple and which can be easily installed at a desired location.

It is a further object of this invention to provide a process which can be conducted at conventional filler slurry solids minimizing the need for dilution and facilitating the preparation of flocculated fillers at concentrations consistent with common paper mill practices.

It is a further object of the invention to provide a process for producing a preflocculated filler composition of good uniformity and which reduces the amount of required flocculating agent.

It is a further object of the invention to provide a process for preparing a preflocculated filler composition for paper in which the particle size of the filler can be readily controlled.

It is a further object of the invention to provide a process which is essentially instantaneous.

The present invention provides a process for forming a preflocculated filler for use in making paper, which process comprises continuously bringing together an aqueous slurry of a paper filler material and a flocculating agent and imparting to the mixture for a period of not more than about 2 minutes and preferably for less than about 30 seconds, a shearing force sufficient to provide a flocculated filler of controlled particle size and most suitable for papermaking.

The filler materials which are used in accordance with this invention are known filler materials commonly used in the art, such as clays, e.g., china clay, lithopone, sulphate, titanium pigments, titanium dioxide, satin white, talc, calcium carbonate, barium sulfate, gypsum, chalk whiting and the like.

Similarly, conventional known flocculating agents can be employed in accordance with the invention. The flocculating agents tend to flocculate together the filler particles and the cellulosic fibers and various materials, generally organic polymers of high molecular weight, are known to be useful flocculating agents. Representative of the flocculating agents are water-soluble vinyl polymers and gums, polyacrylamides, aluminum sulfate, mannogalactanes, and anionic and cationic starch derivatives. The anionic starch derivatives are generally starch derivatives which contain substituent acid groups such as carboxyl, phosphate, sulfate or sulfonate groups. Representative of such anionic starch derivatives are from sodium chloracetate, phosphoryl chloride, sodium trimetaphosphate, phosphoric anhydride, acid anhydrides, such as acetic, maleic, malonic, proprionic and the like. Cationic starch derivatives usually contain primary, secondary or tertiary amino groups or a quaternary ammonium group. The starches can also be cross-linked and dextrinized, oxidized, hydrolyzed, etherified or esterified. Cationic starch derivatives are preferred; representative of such cationic starch derivatives being in the range of 0.010 to 0.15 degree of substitution (D.S.) and the preferred in range of 0.03 to 0.075 degree of substitution. (D.S. is degree of substitution and is equivalent to the number of substituent groups chemically bonded per anhydroglucose unit.) Representative of such cationic starches are derivatives from chlorohydroxypropyl trimethyl ammonium chloride, diethylaminoethyl hydrochloride, chlorobutenyl trimethyl ammonium chloride, 3-chloropropyl trimethyl ammonium chloride N-(3-chloro-2-hydroxypropyl) pyridinium chloride, ethyleneimine and the like.

The amount of the flocculating agent employed can be widely varied and can range from about 0.5 to 60%, preferably 0.5 to 3%, by weight of the filler material.

The method of this invention is more fully described in connection with the accompanying drawings wherein:

FIG. 1 is a diagrammatic flow chart illustrating a typical embodiment of the process of this invention.

FIG. 2 is an enlarged sectional view of a centrifugal pump which can be used to impart mechanical shear in the process of the invention.

FIG. 3 is a graph illustrating the relationship of mechanical shear force to particle size of the flocculated filler.

Figure 4:
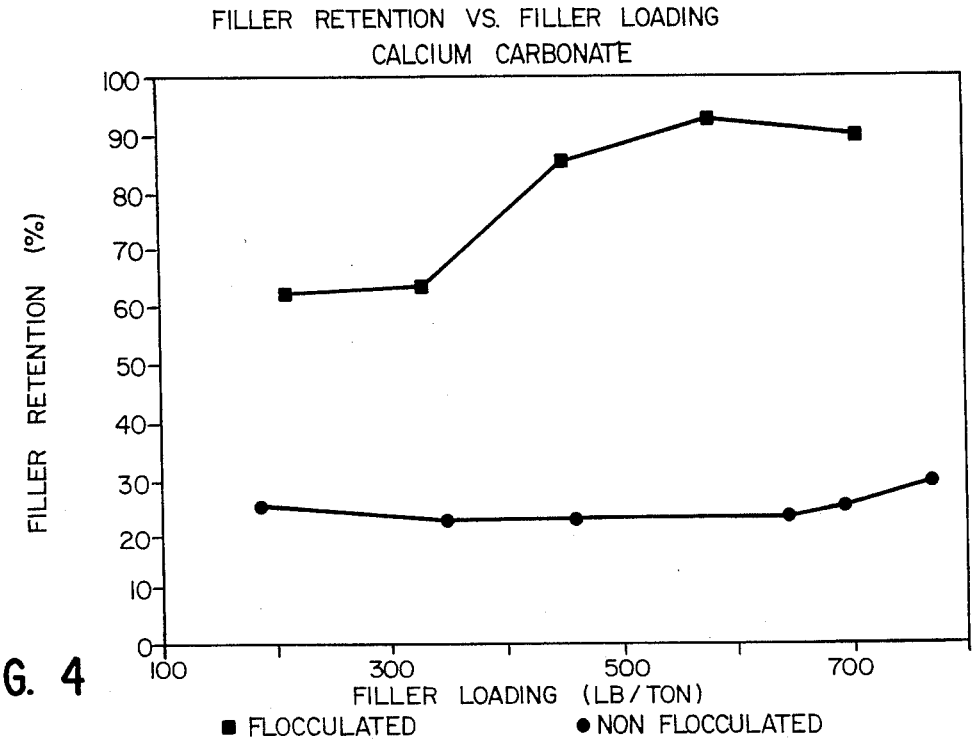
FIG. 4 is a plot of data of filler retention versus filler loading.

Referring to the drawings, FIG. 1 is a flow diagram illustrating a typical process according to this invention. Thus, an aqueous slurry of a paper filler material, such as calcium carbonate, is formed in the slurry tank 1 with the aid of an agitator 2. Slurry concentration will be determined primarily by the filler content desired in the paper product. Generally, the concentration of the filler slurry in tank 1 will be in the range of 5 to 75% dry solids and more preferably in the range of 25–50% dry solids.

A cationic starch paste or other suitable flocculating agent (flocculent) in an aqueous slurry is stored in storage tank 5. The filler slurry is pumped through line 12 by means of a positive displacement pump 3 to centrifugal pump 8. Simultaneously, the flocculating agent is pumped from tank 5 through line 13 by means of positive displacement metering pump 6 to the centrifugal pump 8. The resultant preflocculated filler is pumped by a positive displacement pump 10 and discharged through line 11 and is adapted for incorporation with a paper furnish.

A pressure regulating valve 10, or sufficient head on the discharge side of the pump 8, is employed to maintain the operating pressure or back pressure greater than the shut-off pressure as defined in the performance curve of the centrifugal pump 8. The result is a centrifugal pump unit 8 which works as a mechanical shear mixing device, but with no pumping capacity. Operating pressure is monitored by way of pressure gauges 4, 7 and 9.

FIG. 2 illustrates the construction of a typical centrifugal pump 8, with pressure regulating valve, which, when operated with a back-pressure, imparts mechanical shear to the filler-flocculent mixture. As shown in FIG. 2, the aqueous filler slurry is supplied through an inlet pipe 12 at a known and controlled flow rate into the eye 14 (center) of the impeller 15. The flocculating agent or flocculent flows at a known and controlled flow rate through the pipe 13 also to the impeller eye 14. The impeller 15 is rotated by a motor driven shaft 18. The impeller 15 has radial vanes 16 integrally attached to it. The two liquids flow radially outward in the spaces between the vanes. By the action of the impeller vanes, mixing and back-blending of the fluids along with mechanical shear are accomplished. The velocity of the fluid is increased when contacted by the impeller vanes 16 and the fluid is moved to the periphery where it is collected in the outer edges of the impeller reaction chamber 17. Reacted material then flows toward and out the discharge port 19.

The constant pressure regulating valve 10 maintains a pressure above the shut-off pressure for the centrifugal pump 8. It then becomes an in-line device directing the rotating shaft mechanical energy into the flow medium. The back pressure allows the impeller reaction chamber and space between the vanes to always remain full to avoid cavitation. The material flow rate is determined only by the input fluid flow rate to the pump. By the process of this invention, a preflocculated filler composition of desired particle size can be obtained.

For the description of the invention herein, a typical centrifugal-type of pump was employed to impart mechanical shear in accordance with this invention. Centrifugal pumps operated against a back pressure greater than the pump shut-off pressure, are convenient and suitable devices for use in accordance with the invention. Other means for imparting mechanical shear as described herein include, for example, homogenizers (such as manufactured by Tekmar Co.), shear pumps (such as manufactured by Waukesha Foundry Co.), emulsifiers (such as manufactured by Nettco Corp.), sonic emulsifiers (such as manufactured by Sonic Corp.), colloid mills (such as manufactured by Gaulin Corp.), high speed wet mills (such as manufactured by Day Mixing), jets (such as manufactured by Penberthy Div., Houdaille Industries, Inc.), high intensity mixers (such as manufactured by J. W. Greer, Inc.) and the like.

The intensity of the shearing force to which the filler-flocculent mixture is subjected according to the invention can be varied to control the particle size of the flocculated filler. This affords significant advantages since it is desired to employ flocculated fillers of particular particle size. In general, it is desired that the flocculated filler have an average particle size in the range of about 38 to 75 microns in greatest dimension. The objective is to maximize filler retention while maintaining uniform distribution. The optimum particle size may vary slightly as the application (furnish, paper grade, basis weight, machine configuration, machine speed, etc.) changes; however, this particle size range is quite suitable for general application. Fillers of this particle size range can be easily obtained by regulating the shear under which the filler is produced.

Thus, for a centrifugal pump as described above "shear force" can be calculated by multiplying the shear rate ($sec^{-1}$) of the centrifugal mixer by the dwell time (sec.) of the slurry in the mixing device. "Shear force" = Shear rate × dwell time.

The shear rate of the centrifugal mixer is calculated using:

$$\text{Shear rate (sec.}^{-1}) = \frac{(n \times d)(1/60)}{(v - d)/2}. \qquad \text{Equation 1}$$

Where:

n = Speed, RPM d = Impeller diameter

V = Volute diameter (Volute = the chamber in which the impeller is enclosed.)

The dwell time in the mixing device at various flow rates can be calculated using:

$$\text{Dwell time (sec.)} = \frac{\text{Void Volume Of Volute}}{\text{Flow Rate (mls./sec.)}}. \qquad \text{Equation 2}$$

FIG. 3 is a plot showing the weight percentage of flocculated filler having a particle size within the range of 38 and 75 obtained with different "shear forces". The data plotted in FIG. 3 was obtained with calcium carbonate as the filler and a cationic starch of a quaternary ammonium salt having a degree of substitution of 0.0992 as the flocculent and using as the shear imparting device a centrifugal pump as described in Example 1. With a centrifugal pump of this type the rate of shear depends on the diameter and speed of the pump impeller. Since the size of the impeller remained constant, the rate of shear was directly proportional to the speed (R.P.M. or revolutions per minute) of the impeller.

As is readily apparent from the data plotted in FIG. 3, less flocculated filler having a particle size of 38–75 microns is obtained as the shear force increases. Thus, as seen from FIG. 3, approximately 87% of flocculated filler was in the 38–75 micron size range with a shear force of 3000 while only about 5% of the filler had a particle size in that range when using a shear force of about 9500. One can routinely employ a suitable shear device to obtain shear data similar to those plotted in FIG. 3. From such data, the shear force required to obtain a filler having a particle size in the desired range can be readily determined.

The following examples illustrate the invention and the advantages thereof. In the numbered examples, unless otherwise indicated flocculation was achieved by use of a shear device as described with reference to FIGS. 1 and 2.

EXAMPLE 1

An aqueous clay slurry at 20% dry solids was pumped at a rate of 2,600 milliliters per minute to the centrifugal mixing device described above. A ten percent cationic starch slurry (0.036 D.S.) was simultaneously pumped through the mixer at a rate of 200 milliliters per minute. The cationic starch derivative used was the ether formed when 3-chloro-2-hydroxypropyltrimethylammonium chloride reacts with starch to give a starch ether with a hydroxypropyltrimethylammonium chloride side chain.

Clay and starch floccules were produced continuously, essentially instantaneously, upon interaction. The flocculated slurry was collected at the discharge and screened for subjective particle size analysis. All material larger than 75 microns was labeled "residue". The material smaller than 45 microns was labeled "fines". Particles between 38 and 75 microns are considered suitable for wet-end application in paper. The initial clay slurry could be described as 100% fines using this test method. The floccules had a predominant particle size within the range of 38 and 75 microns. Upon screening the flocculated material, the quantity greater than 75 microns (residue) and smaller than 38 microns (fines) was considered negligible.

EXAMPLE 2

Following the procedure outlined in Example 1, similar runs were performed on clay slurries containing from 20 to 40% dry solids. The starch paste having a concentration of 10% (wt./vol.) and a degree of substitution of 0.036 was applied at levels ranging 2.1 to 8.8 percent (dry starch) on dry solids clay. The varying conditions for flocculation were as follows:

TABLE 1

| Run | Starch Flow (mls./min.) | Clay Solids (%) | Clay Flow (mls./min.) | % Starch on Clay |
|---|---|---|---|---|
| 1 | 260 | 20 | 1,300 | 8.8 |
| 2 | 118 | 20 | 1,300 | 4.0 |
| 3 | 380 | 20 | 4,200 | 4.0 |
| 4 | 182 | 20 | 2,000 | 4.0 |
| 5 | 296 | 36 | 1,600 | 4.0 |
| 6 | 154 | 36 | 1,600 | 2.1 |
| 7 | 222 | 36 | 1,600 | 3.0 |
| 8 | 184 | 36 | 1,600 | 2.5 |
| 9 | 204 | 36 | 1,600 | 2.75 |
| 10 | 212 | 40 | 1,600 | 2.5 |

The particle size of the clay slurry was significantly increased in each run based upon the test procedure described in Example 1. This demonstrated that clay slurries could be effectively flocculated over a wide range of filler solids, starch additions, and flow rates. All the flocculated samples upon screening were predominantly of a particle size between 45 and 75 microns.

EXAMPLE 3

This run was performed to demonstrate the ability to continuously flocculate a calcium carbonate slurry with a cationic starch to obtain aggregates of desirable particle size. The calcium carbonate was a coarse ground grade, with 30% of the particles less than 2 microns in diameter. A 30% dry solids calcium carbonate slurry was pumped at a flow rate of 2,800 milliliters per minute to the mixing device. A five percent paste of a 0.099 D.S. quaternary cationic starch was pumped through the centrifugal mixer at a rate of 320 milliliters per minute. Analysis of the particle size distribution appears in Table 2.

This run demonstrates that a calcium carbonate slurry can be effectively flocculated using a cationic starch to continuously produce aggregates between 38 and 75 microns.

TABLE 2

| | | | Weight of Particles | | | |
|---|---|---|---|---|---|---|
| Run | % Starch on $CaCO_3$ | $CaCO_3$ Solids (%) | >75 | <75 >45 | <45 >38 | <38 Microns |
| 1 | 1.5 | 30 | 6.6 | 50.9 | 9.5 | 33.0 |

Commercially available fillers which have not been flocculated are typically much smaller—i.e., 100% less than 38 microns and about 30% less than 1 micron.

EXAMPLE 4

A 72% dry solids calcium carbonate slurry was flocculated with a 0.042 D.S. cationic starch.

A 1.0% starch loading was employed at a total flow (starch and filler) of 1,836 milliliters per minute. Particle size results are summarized in Table 3.

This run demonstrates the ability to flocculate a high solids slurry and obtain a quantity of flocccules between 38 and 75 microns.

TABLE 3

| | | | Weight of Particles | | | |
|---|---|---|---|---|---|---|
| Run | % Starch on $CaCO_3$ | $CaCO_3$ Solids (%) | >75 | <75 >45 | <45 >38 | <38 Microns |
| 1 | 1.0 | 72 | 13.0 | 20.1 | 27.7 | 39.2 |

EXAMPLE 5

A series of six flocculated samples were prepared from a 72% calcium carbonate slurry. The filler slurry flow was held constant at 1,650 milliliters per minute. Addition levels of 0.028 D.S. cationic starch ranged from 0.5–3.0% (dry starch) on dry calcium carbonate. The samples were then screened to determine the particle size distribution. Test results are presented in Table 4.

The results show that the average particle size of the floccules decreased as the starch loading increased.

Similar samples were prepared and tested using a 0.056 D.S. cationic starch. The same trend was observed. The average particle size of the system decreased as the level of starch increased. The particle size of the floccules produced using the 0.056 D.S. cationic starch was consistently greater than those produced with the 0.028 D.S. cationic starch. Particle size distribution data for the 0.056 D.S. cationic starch samples appears in Table 5.

TABLE 4

| Run | % 0.028 D.S. Starch on $CaCO_3$ | Weight % of Particles >75 | <75 >38 | <38 Microns |
|---|---|---|---|---|
| 1 | 0.5 | 91.6 | 3.8 | 4.7 |
| 2 | 1.0 | 77.9 | 13.8 | 8.2 |
| 3 | 1.5 | 67.5 | 19.7 | 12.8 |
| 4 | 2.0 | 57.6 | 14.2 | 28.2 |
| 5 | 2.5 | 20.2 | 47.6 | 32.2 |
| 6 | 3.0 | 14.6 | 16.0 | 69.3 |

TABLE 5

| Run | % 0.056 D.S. Starch on $CaCO_3$ | Weight % of Particles >75 | <75 >38 | <38 Microns |
|---|---|---|---|---|
| 1 | 0.5 | 93.4 | 1.6 | 5.1 |
| 2 | 1.0 | 92.1 | 2.2 | 5.7 |
| 3 | 1.5 | 87.4 | 3.8 | 8.7 |
| 4 | 2.0 | 81.6 | 6.4 | 12.0 |
| 5 | 2.5 | 81.0 | 8.5 | 10.5 |
| 6 | 3.0 | 71.3 | 16.9 | 11.8 |

The results illustrate that varying the cationicity (D.S.) as well as the starch loading level affects the particle size of flocculated filler.

EXAMPLE 6

A Dynamic Drainage Jar available from Paper Research Materials, Inc., 770 James Street, Apt. 1206, Syracuse, N.Y. 13203 and Paper Chemistry Laboratory, Inc., Stoneleigh Avenue, Carmel, N.Y. 10512 was used to determine the retention characteristics of the flocculated samples described in Example 5. The fiber furnish consisted of a 75% bleached kraft hardwood, 25% bleached kraft softwood blend. The fibers were refined to 400milliliters Canadian Standard Freeness in a Valley beater at 1.56% consistency. The refined stock was then diluted to 0.5% consistency.

A 500 milliliter charge of the dilute stock was added to the drainage chamber under 750 RPM agitation. Calcium carbonate was then added at ten percent on fiber from a 2.5% slurry. After allowing 15 seconds for mixing, a high molecular weight, low charge density, quaternary cationic retention aid was added at a level of 0.5 pound per ton (0.025%). The furnish was allowed to mix for an additional 15 seconds prior to drainage. A 30 milliliter aliquot was collected and discarded. A 100 milliliter sample was then collected and saved for calcium carbonate retention analysis. Calcium carbonate retention was determined using an EDTA titration procedure.

The results of the experiment are tabulated in Tables 6 and 7. The flocculated filler samples exhibited significantly higher filler retention compared to the nonflocculated sample.

A value referred to as "cationicity" or "cationic demand" was calculated as the product of the starch (D.S. =degree of substitution) and the loading level (% on filler) (D.S.×percent on filler). The cationicity provides a quantitative number for the amount of positive charge in the system contributed by the cationic starch. Generally, the cationicity or cationic demand will be in the range of about 0.01 to 2 and preferably in the range of about 0.03 to 0.3.

In the runs conducted using the 0.028 D.S. starch, an optimum cationicity was not achieved. A cationicity between 0.028 and 0.085 appears optimum based on the 0.056 D.S. cationic starch.

Under similar cationicity conditions, the 0.056 D.S. cationic starch provided superior retention. The floccules formed with the higher dry solids starch are considered to be more resistant to shear. In either case, the flocculated filler provided a significant improvement in retention over the conventional practice of utilizing a retention aid in the furnish.

TABLE 6

| Run | % 0.028 D.S. Starch on $CaCO_3$ | "Cationicity" | % $CaCO_3$ Retention |
|---|---|---|---|
| Control - Unflocculated $CaCO_3$ | 0 | 0 | 33.0 |
| 1 | 0.5 | 0.0139 | 44.4 |
| 2 | 1.0 | 0.0278 | 44.1 |
| 3 | 1.5 | 0.0417 | 46.7 |
| 4 | 2.0 | 0.0556 | 39.0 |
| 5 | 2.5 | 0.0695 | 53.2 |
| 6 | 3.0 | 0.0834 | 55.4 |

TABLE 7

| Run | % 0.056 D.S. Starch on $CaCO_3$ | "Cationicity" | % $CaCO_3$ Retention |
|---|---|---|---|
| Control - Unflocculated | 0 | 0 | 33.0 |
| 1 | 0.5 | 0.0282 | 58.8 |
| 2 | 1.0 | 0.0564 | 72.1 |
| 3 | 1.5 | 0.0846 | 51.3 |
| 4 | 2.0 | 0.1128 | 56.4 |
| 5 | 2.5 | 0.1410 | 54.7 |
| 6 | 3.0 | 0.1692 | 50.5 |

Cationicity = (Starch D.S.) (% starch on filler)
Example - (0.0564 D.S.) (1.0% starch on filler) = 0.0564 cationicity

EXAMPLE 7

Both flocculated and nonflocculated calcium carbonate were used in the production of 65 g/m$^2$ paper on a pilot Fourdrinier machine. The fiber furnish was 75% bleached kraft hardwood, 25% bleached kraft softwood. The dry lap pulps were disintegrated in a beater and refined at 3% in a claflin refiner to 400±10 milliliters Canadian Standard Freeness.

A 50% slurry of coarse ground calcium carbonate was used. The flocculated samples were prepared at a slurry flow rate of 4,800 milliliters per minute. A seven percent cationic paste (0.045 D.S.) was added at 1.5% on filler. Flocculated and nonflocculated filler was added at 10, 20, 30 and 40 percent on fiber. Overall calcium carbonate retention results appear in Table 8.

The flocculated filler demonstrated significantly higher retention than the nonflocculated material. Sheets formed with the flocculated filler exhibited good formation quality.

TABLE 8

| Run | $CaCO_3$ Loading (% on fiber) | $CaCO_3$ Form | Overall $CaCO_3$ Retention (%) |
|---|---|---|---|
| 1 | 9.4 | n.f. | 25.26 |
| 2 | 10.6 | f. | 62.45 |
| 3 | 23.0 | n.f. | 22.98 |
| 4 | 22.7 | f. | 85.19 |
| 5 | 32.2 | n.f. | 22.80 |
| 6 | 29.1 | f. | 92.13 |
| 7 | 38.4 | n.f. | 29.10 |
| 8 | 35.4 | f. | 89.20 |

n.f. = nonflocculated
f. = flocculated

EXAMPLE 8

A flocculated calcium carbonate slurry was prepared at 50% solids using a 1.0% addition of a 0.069 D.S. cationic starch. The filler slurry flow rate was 4,800 milliliters per minute. The flocculated samples were used in the production of paper as described in Example 7. Nonflocculated calcium carbonate was also used for comparative purposes. Filler loadings of 0, 20 and 40 percent on fiber were used. In selected runs an alkyl ketene dimer internal size was added at 0.3% on total dry solids. Sizing effectiveness was measured 24 hours later using the Hercules Size Tester (HST). The results appear in Table 9.

The results illustrate the ability to use flocculated calcium carbonate in an alkaline system with an alkyl ketene dimer and develop good sizing. The cationic starch present in the flocculated filler systems contributed to improved retention of the alkaline size. This is demonstrated by superior sizing compared to the nonflocculated runs.

TABLE 9

| Run | $CaCO_3$ Loading (% on fiber) | $CaCO_3$ Form | First Pass $CaCO_3$ Retention (%) | Alkaline Size (%) | HST (sec.) |
|---|---|---|---|---|---|
| 1 | 0 | — | — | 0 | 0.2 |
| 2 | 0 | — | — | 0.3 | 681.4 |
| 3 | 25.7 | n.f. | 25.2 | 0 | 0.2 |
| 4 | 18.8 | f. | 59.9 | 0 | 0.2 |
| 5 | 25.6 | n.f. | 19.6 | 0.3 | 195.4 |
| 6 | 24.6 | f. | 64.9 | 0.3 | 428.3 |
| 7 | 35.9 | n.f. | 13.5 | 0 | 0.1 |
| 8 | 32.0 | f. | 53.7 | 0 | 0.4 |
| 9 | 39.3 | n.f. | 29.9 | 0.3 | 146.1 |
| 10 | 32.7 | f. | 47.9 | 0.3 | 389.2 |

EXAMPLE 9

A 30% dry solids titanium dioxide slurry (particle size 0.15–0.3 microns) was flocculated as in Example 1. The slurry flow to the mixer was 3,340 milliliters per minute. A 7% cationic starch paste (0.057 D.S.) was pumped through the mixer at 280 milliliters per minute. This corresponds to a 1.5% add-on dry solids filler. Flocculation was conducted at a shear force of 4814. The resulting slurry was screened to determine the aggregate particle size. The results (Table 10) demonstrate the ability to continuously flocculate titanium dioxide to a substantially larger particle size.

TABLE 10

| Run | % Starch Loading | $TiO_2$ Solids | Weight % of Particles >75 | <75 >45 | <45 >38 | <38 Microns |
|---|---|---|---|---|---|---|
| 1 | 1.5 | 30% | 28.2 | 18.1 | 1.6 | 52.0 |

This illustrates the ability of the process to suitably flocculate titanus pigment in addition to the kaolinitic clays and calcium carbonate as previously described.

EXAMPLE 10

A 30% solids slurry containing 50/50 by weight titanium dioxide and calcium carbonate presenting a material of which 65% was less than one micron was flocculated using the conditions described in Example 9. The resulting flocculated slurry was screened to determine the particle size distribution. The results are summarized in Table 11. Microscopic examination of the floccules produced revealed a heterogeneous aggregate containing starch, calcium carbonate and titanium dioxide. The results of this experiment demonstrate that a filler slurry containing titanium dioxide and calcium carbonate can be continuously "co-flocculated" with a cationic starch to produce aggregates containing both filler types.

TABLE 11

| Run | % Starch on Filler | Slurry Solids | Weight % of Particles >75 | <75 >45 | <45 >38 | 38 Microns |
|---|---|---|---|---|---|---|
| 1 | 1.5 | 30% | 69.8 | 8.8 | 10.6 | 10.8 |

The ability to simultaneously floc various combinations of filler additives (co-flocculation) by a process which is continuous and essentially instantaneous offers many benefits to a user such as a papermaker. In addition to providing heterogeneous flocs of controlled composition, the process provides the flexibility to change product composition according to needs. In addition, the process eliminates the need for multiple systems and helps to control and minimize the quantity of material in process.

EXAMPLE 11

An experiment was performed to investigate the effect of increasing the flow through the centrifugal mixer on the particle size of the floccules produced. A 30% calcium carbonate slurry was flocculated using a 0.099 D.S. cationic starch. A 1.5% addition of starch on filler was maintained over flow rates ranging from 1835 to 6330 milliliters per minute. Particle size analysis results are summarized in Table 12.

The results of this experiment demonstrate the ability to control the particle size of the aggregates by regulating the shear under which they are produced. The shear can be regulated by: (1) changing the effective dwell time (flow rate), (2) changing the speed of the shear unit (RPM) and (3) changing the size of the shear unit (d).

TABLE 12

| Run | Slurry Flow (mls./min.) | Starch Flow (mls./min.) | Weight % of Particles >75 | <75 >45 | <45 >38 | 38 Microns |
|---|---|---|---|---|---|---|
| 1 | 1,650 | 185 | 0.0 | 1.7 | 2.7 | 95.7 |
| 2 | 2,420 | 280 | 5.5 | 53.2 | 34.0 | 7.3 |
| 3 | 2,800 | 320 | 6.6 | 50.9 | 9.5 | 33.0 |
| 4 | 3,300 | 370 | 7.2 | 55.8 | 2.4 | 34.7 |
| 5 | 4,000 | 450 | 9.7 | 68.9 | 4.5 | 17.0 |

TABLE 12-continued

| Run | Slurry Flow (mls./min.) | Starch Flow (mls./min.) | Weight % of Particles >75 | <75 >45 | <45 >38 | 38 Microns |
|---|---|---|---|---|---|---|
| 6 | 4,750 | 535 | 9.6 | 67.5 | 0.9 | 22.0 |
| 7 | 5,700 | 630 | 9.9 | 75.4 | 10.8 | 3.9 |

EXAMPLE 12

Both flocculated and nonflocculated calcium carbonate were used in the production of 65 g/m$^2$ paper on a pilot Fourdrinier machine. The fiber furnish was 75% bleached kraft hardwood, 25% bleached kraft softwood. The dry lap pulps were disintegrated in a beater and refined at 3% in a claflin refiner to 400±10 milliliters Canadian Standard Freeness.

A 50% slurry of coarse ground calcium carbonate was used. The flocculated samples were prepared at a slurry flow rate of 4,800 milliliters per minute. A seven percent cationic starch paste (0.045 D.S.) was added at 1.5% on filler. Flocculated and nonflocculated filler was added at 10, 20, 30 and 40 percent on fiber.

Figure 5:
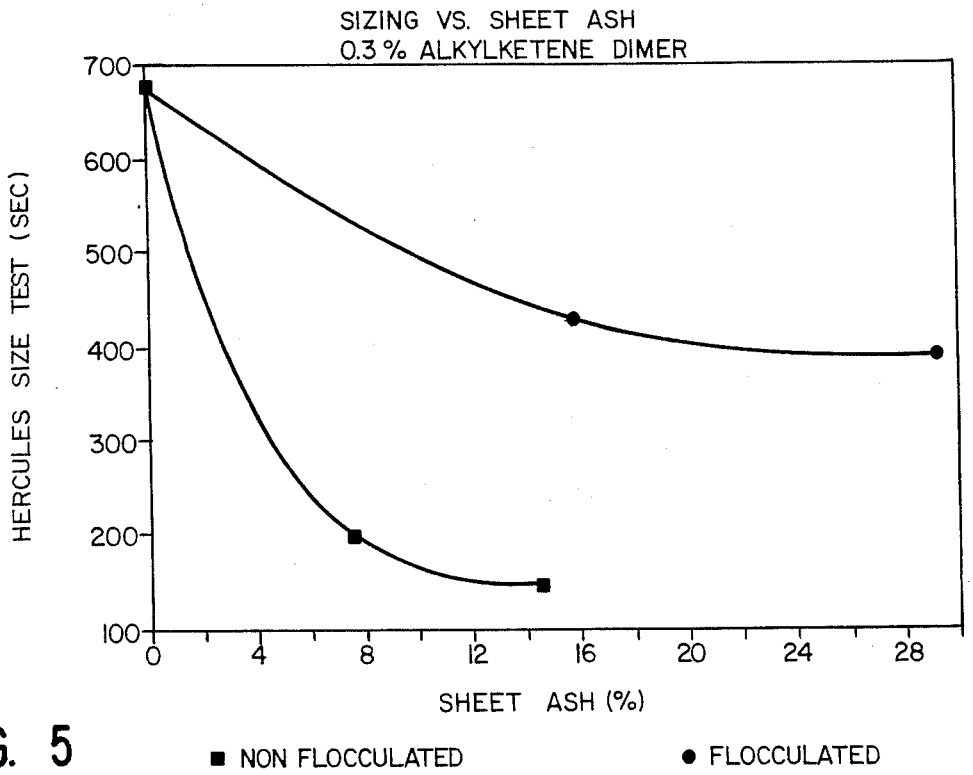
FIG. 5 is a plot of sizing retention data.
Figure 6:
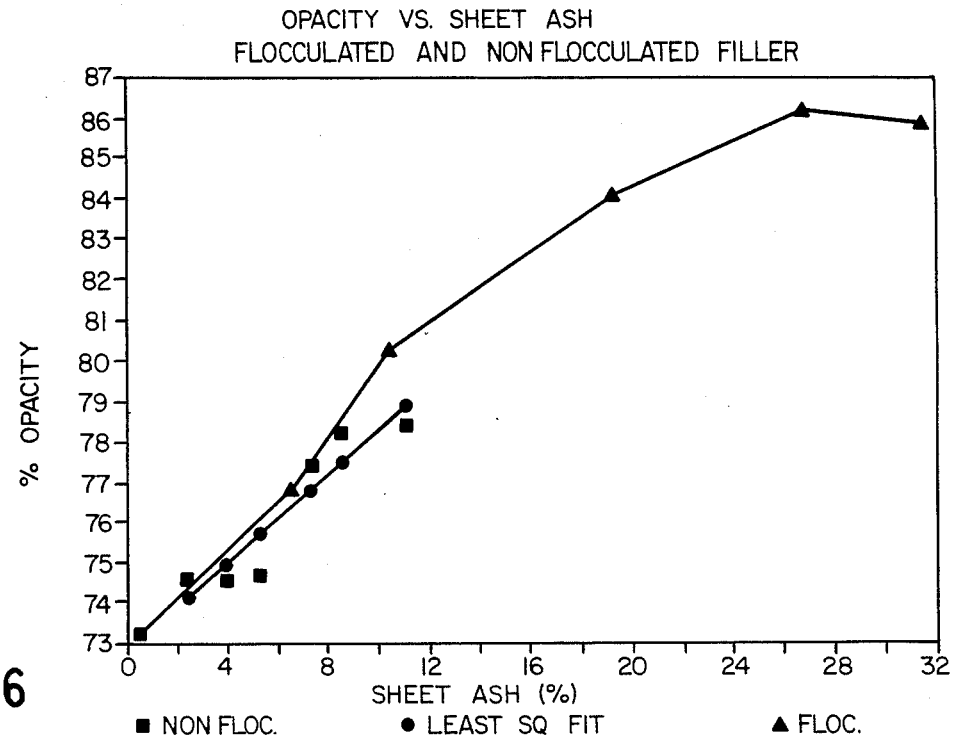
FIG. 6 is a plot of opacity data.
Figure 7:
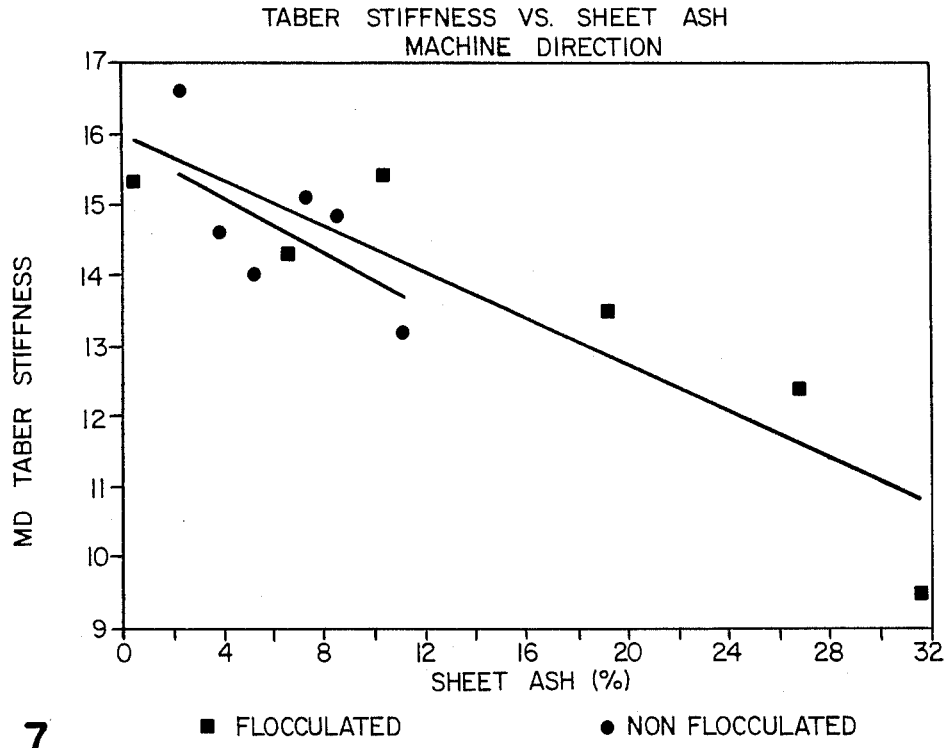
FIGS. 7 and 8 are plots of paper stiffness data.
Figure 8:
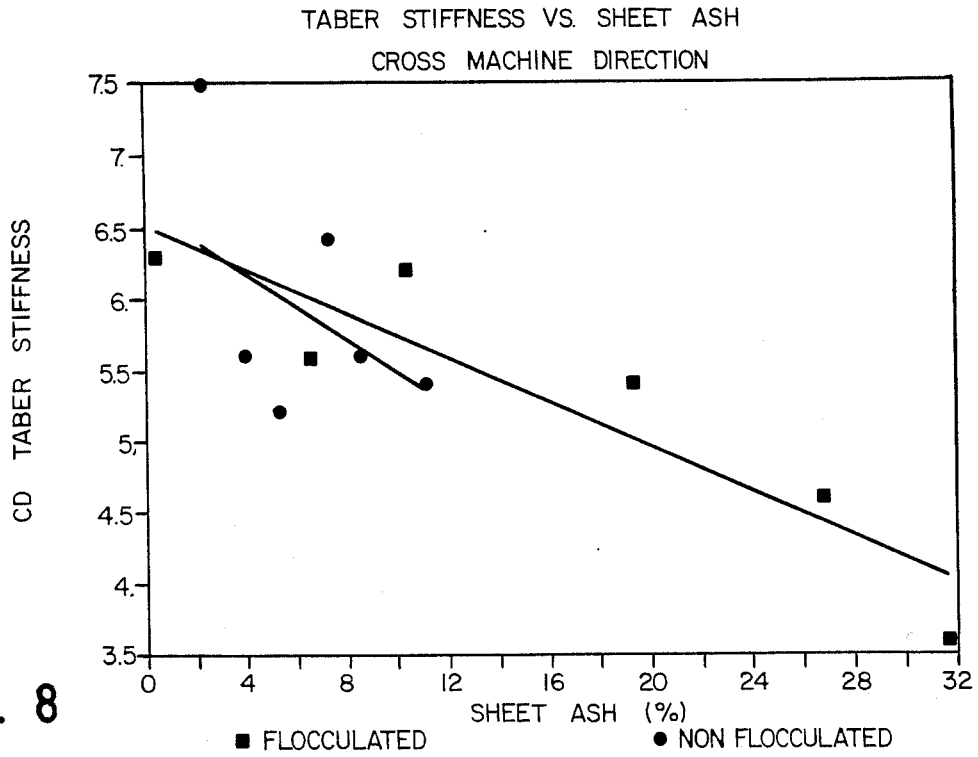
Figure 9:
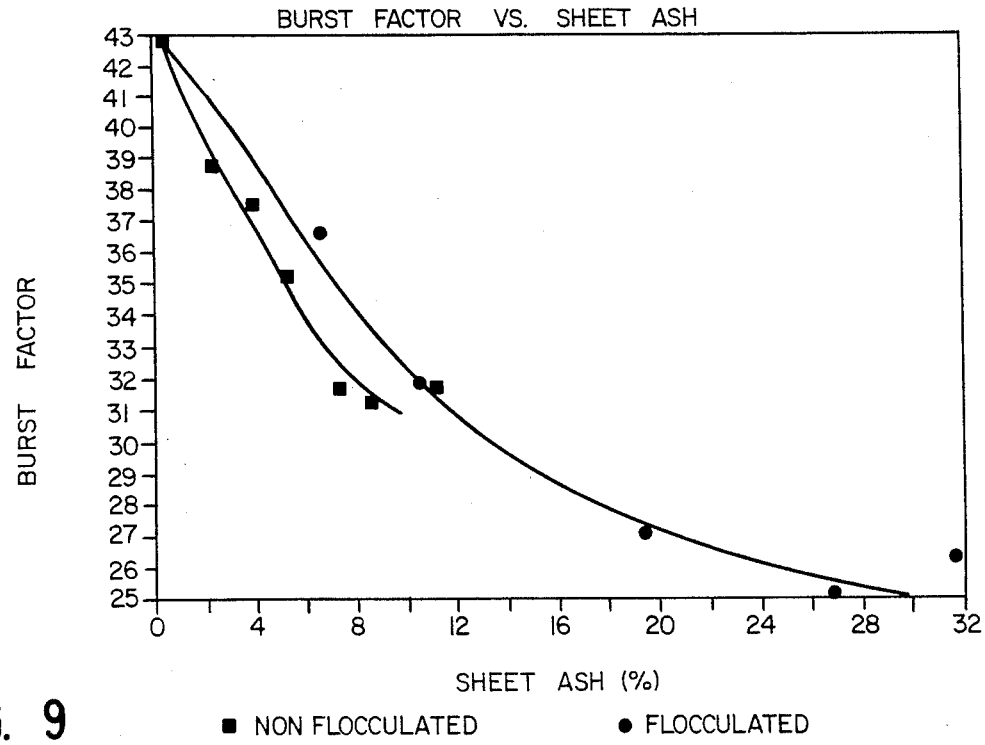
FIG. 9 is a plot of paper bursting strength data.

The paper was tested extensively for various properties. Significant improvement in filler retention was achieved when using flocculated calcium carbonate, especially considering no retention aid was present as shown from data plotted in FIG. 4. The alkaline sizing was well retained without a retention aid as is generally required as shown by the data plotted in FIG. 5. Moreover, opacity was improved at given sheet ash when flocculated calcium carbonate was utilized as seen from the data plotted in FIG. 6. Furthermore, stiffness was improved at a given sheet ash level when flocculated filler was used as seen from the data plotted in FIGS. 7 and 8. Also, the bursting strength of the paper was improved at given ash levels when the flocculated fillers were used as shown by the data plotted in FIG. 9.

Those modifications and equivalents which fall within the spirit of the invention are to be considered a part thereof.

What is claimed is:

1. A process of forming a flocculated filler for use in making paper or paperboard which consists in continuously introducing an aqueous slurry of a non-flocculated paper filler material and an aqueous slurry of from 0.5 to 60% by weight of the filler material of a flocculating agent into a shear imparting device and imparting to the mixture within said device a shearing force sufficient to provide flocculated filler particles of a size adapted for use in papermaking without any additional treatment and continuously removing said flocculated filler particles from the shear imparting device.

2. A process according to claim 1 wherein the shearing force is imparted for a period less than 2 minutes.

3. A process according to claim 1 wherein the shearing force is imparted for a period less than 30 seconds.

4. A process according to claim 1 wherein the flocculating agent is a cationic starch paste.

5. A process according to claim 1 wherein the filler material is a filler material selected from clays, calcium carbonate and titanium dioxide.

6. A process according to claim 1 wherein the shearing force is sufficient to provide flocculated filler particles having an average size of from 38 to 75 microns in greatest dimension.

7. A process according to claim 1 wherein the paper filler material comprises more than one filler material.

* * * * *

UNITED STATES PATENT AND TRADEMARK OFFICE

CERTIFICATE OF CORRECTION

PATENT NO. : 4,799,964

DATED : January 24, 1989

INVENTOR(S) : RICHARD D. HARVEY and ROBERT E. KLEM

It is certified that error appears in the above-identified patent and that said Letters Patent is hereby corrected as shown below:

Column 10, line 31, in the heading for the last column of Table 11, before "38 microns" insert -- < --

Column 10, line 63, in the heading for the last column of Table 12, before "38 microns" insert -- < --

Column 11, line 3, in the heading for the last column of Table 12-continued, before "38 microns" insert -- < --

Signed and Sealed this

Twenty-sixth Day of December, 1989

*Attest:*

JEFFREY M. SAMUELS

*Attesting Officer* *Acting Commissioner of Patents and Trademarks*